US009617117B2

(12) United States Patent
Rogers

(10) Patent No.: US 9,617,117 B2
(45) Date of Patent: Apr. 11, 2017

(54) ELEVATOR BRAKE CONTROL INCLUDING A SOLID STATE SWITCH IN SERIES WITH A RELAY SWITCH

(75) Inventor: Kyle W. Rogers, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 364 days.

(21) Appl. No.: 14/347,652

(22) PCT Filed: Oct. 6, 2011

(86) PCT No.: PCT/US2011/055042

§ 371 (c)(1),
(2), (4) Date: Mar. 27, 2014

(87) PCT Pub. No.: WO2013/052051

PCT Pub. Date: Apr. 11, 2013

(65) Prior Publication Data

US 2014/0231181 A1 Aug. 21, 2014

(51) Int. Cl.
*B66B 1/34* (2006.01)
*B66B 5/00* (2006.01)
(Continued)

(52) U.S. Cl.
CPC ..... *B66B 5/0031* (2013.01); *B66B 1/32* (2013.01); *B66B 5/18* (2013.01); *B66B 13/22* (2013.01)

(58) Field of Classification Search
CPC B66B 5/0031; B66B 1/32; B66B 5/18; B66B 13/22
(Continued)

(56) References Cited

U.S. PATENT DOCUMENTS 4,898,263 A 2/1990 Manske et al.
5,020,640 A 6/1991 Nederbragt
(Continued)

FOREIGN PATENT DOCUMENTS

CN 101367479 A 2/2009
EP 1037354 A2 9/2000
(Continued)

OTHER PUBLICATIONS

State Intellectual Property Office of People's Republic China, First Search, Application No. 201180073999.7 dated Oct. 29, 2014.
(Continued)

*Primary Examiner* — Anthony Salata
(74) *Attorney, Agent, or Firm* — Carlson, Gaskey & Olds

(57) ABSTRACT

An exemplary elevator brake control device includes a relay switch that is associated with a safety chain configured to monitor at least one condition of a selected elevator system component. The relay switch is selectively closed to allow power supply to an electrically activated elevator brake component responsive to the monitored condition having a first status. The relay switch is selectively opened to prevent power supply to the brake component responsive to the monitored condition having a second, different status. A solid state switch is in series with the relay switch between the relay switch and the brake component. A driver selectively controls the solid state switch to selectively allow power to be supplied to the brake component only if the relay switch is closed and the monitored condition has the first status.

20 Claims, 1 Drawing Sheet

(51) Int. Cl.
*B66B 1/32* (2006.01)
*B66B 5/18* (2006.01)
*B66B 13/22* (2006.01)

(58) Field of Classification Search
USPC ..... 187/247, 288, 289, 391, 393
See application file for complete search history.

(56) References Cited

U.S. PATENT DOCUMENTS

| | | | | |
|---|---|---|---|---|
| 5,765,664 | A | 6/1998 | Herkel et al. | |
| 6,467,585 | B1 | 10/2002 | Gozzo et al. | |
| 6,603,398 | B2 | 8/2003 | Tinone et al. | |
| 7,176,653 | B2 | 2/2007 | Jahkonen | |
| 7,353,916 | B2 | 4/2008 | Angst | |
| 7,575,102 | B2 * | 8/2009 | Matsuoka | B66B 5/02 187/391 |
| 7,681,693 | B2 | 3/2010 | Tegtmeier et al. | |
| 7,775,327 | B2 | 8/2010 | Abraham et al. | |
| 7,896,135 | B2 * | 3/2011 | Kattainen | B66B 1/30 187/248 |
| 7,896,138 | B2 * | 3/2011 | Syrman | B66B 5/0031 187/289 |
| 7,938,231 | B2 * | 5/2011 | Ueda | B66B 5/02 187/288 |
| 8,167,094 | B2 * | 5/2012 | Ueda | B66B 1/32 187/288 |
| 8,261,885 | B2 * | 9/2012 | Ketoviita | B66B 5/0043 187/314 |
| 8,272,482 | B2 * | 9/2012 | Takahashi | B66B 1/32 187/288 |
| 8,365,872 | B2 * | 2/2013 | Ueda | B66B 5/04 187/248 |
| 8,430,212 | B2 * | 4/2013 | Ueda | B66B 5/0031 187/247 |
| 8,585,158 | B2 | 11/2013 | Gewinner et al. | |
| 8,820,484 | B2 * | 9/2014 | Rui | B66B 1/32 187/288 |
| 9,309,090 | B2 * | 4/2016 | De Coi | B66B 5/0031 |
| 2007/0272491 | A1 | 11/2007 | Kattainen et al. | |
| 2007/0272492 | A1 | 11/2007 | Tegtmeier et al. | |
| 2008/0308360 | A1 | 12/2008 | Weinberger et al. | |
| 2011/0048863 | A1 | 3/2011 | Schroeder-Brumloop et al. | |
| 2011/0094837 | A1 | 4/2011 | Gewinner et al. | |
| 2012/0186914 | A1 * | 7/2012 | Birrer | B66B 13/22 187/247 |
| 2013/0213745 | A1 * | 8/2013 | Kattainen | H02P 3/02 187/288 |

FOREIGN PATENT DOCUMENTS

| | | | |
|---|---|---|---|
| EP | 0767133 | B1 | 7/2002 |
| EP | 1444770 | B1 | 10/2008 |
| EP | 2326006 | | 5/2011 |
| JP | 2002037545 | A | 2/2002 |
| JP | 2003081543 | A | 3/2003 |
| JP | 2009012946 | A | 1/2009 |
| JP | 2009046231 | A | 3/2009 |
| WO | 2005073121 | A2 | 8/2005 |

OTHER PUBLICATIONS

International Preliminary Report on Patentability for International application No. PCT/US2011/055042 dated Apr. 17, 2014.
Notice of opposition to a European patent; Patent opposed Patent No. 1 444 770.
International Search Report and Written Opinion of the International Searching Authority for International Application No. PCT/US2011/055042 dated May 8, 2012.
Extended European Search Report for European Application No. 11873621.4, mailed May 11, 2015.

* cited by examiner

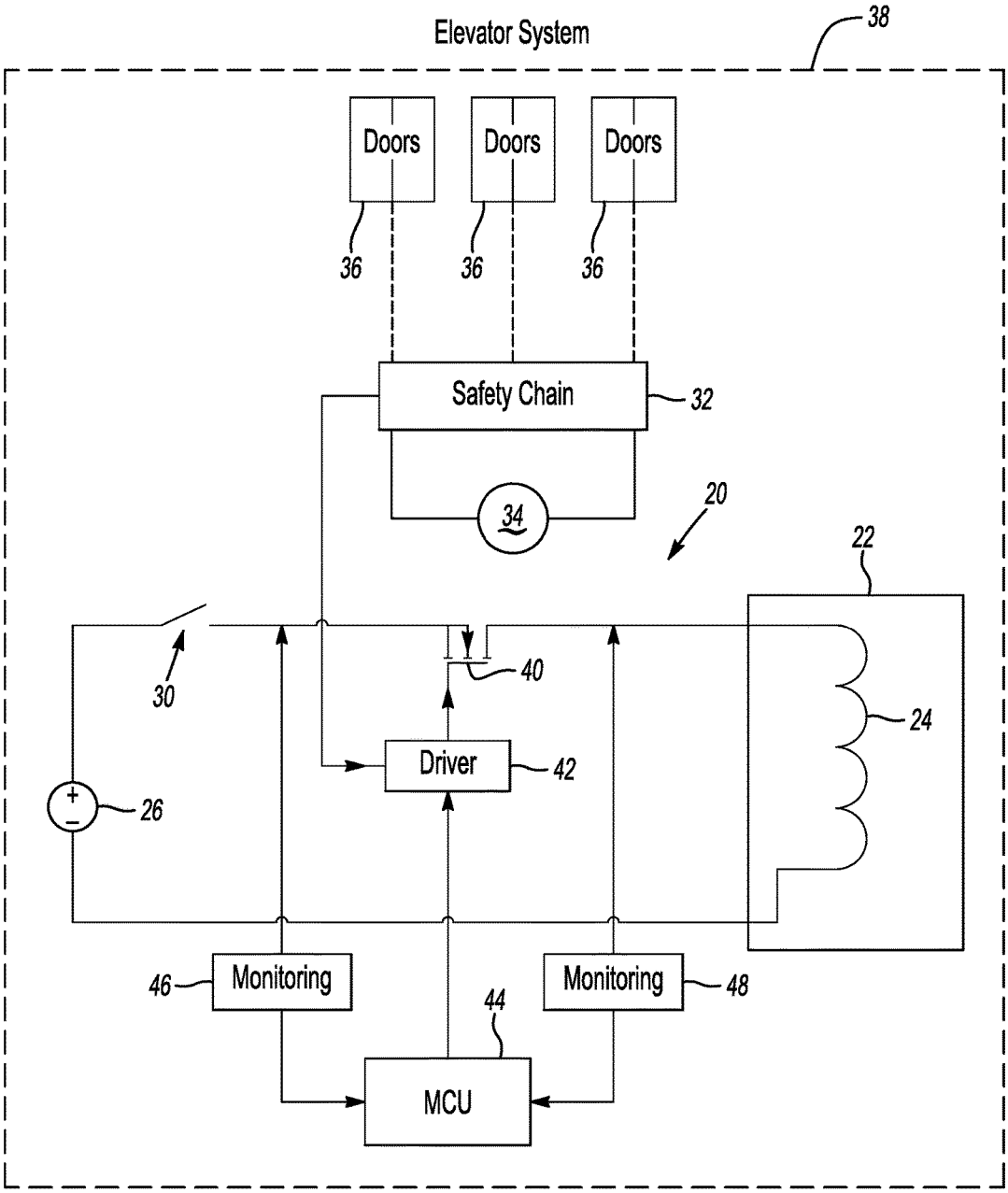
Elevator System
38
Doors
Doors
Doors
36
36
36
Safety Chain
32
34
20
22
30
40
24
Driver
42
26
46
Monitoring
Monitoring
48
44
MCU

ELEVATOR BRAKE CONTROL INCLUDING A SOLID STATE SWITCH IN SERIES WITH A RELAY SWITCH

BACKGROUND

Elevator systems include a variety of components for controlling movement of the elevator car. For example, an elevator brake is responsible for decelerating a moving elevator car and holding a parked car at the proper landing. Typical elevator brakes are applied by spring force and lifted or released by electric actuation. Power is required to the brake for lifting the brake so that the elevator car can move. In the event of power loss, for example, the spring force applies the brake to prevent undesired movement of the elevator car.

An elevator safety chain is associated with the components that supply power to the brake. The safety chain provides an indication of the status of the elevator car doors or any of the doors along the hoistway. When the safety chain indicates that at least one door is open, for example, the elevator car should not be allowed to move.

Allowing the safety chain to control whether power is supplied to the elevator brake has typically been accomplished using high cost relays. Elevator codes require confirming proper operation of those relays. Therefore, relatively expensive, force guided relays are typically utilized for that purpose. The force guided relays are expensive and require significant space on drive circuit boards. Force guided relays are useful because they allow for monitoring relay actuation in a fail safe manner. They include two contacts, one of which is normally closed and the other of which is normally open. One of the contacts allows for the state of the other to be monitored, which fulfills the need for monitoring actuation of the relays.

Elevator system designers are always striving to reduce cost and space requirements. Force guided relays interfere with accomplishing both of those goals because they are relatively expensive and require a relatively large amount of space on a circuit board, for example.

SUMMARY

An exemplary elevator brake control device includes a relay switch that is associated with a safety chain configured to monitor at least one condition of a selected elevator system component. The relay switch is selectively closed to allow power supply to an electrically activated elevator brake component responsive to the monitored condition having a first status. The relay switch is selectively opened to prevent power supply to the brake component responsive to the monitored condition having a second, different status. A solid state switch is in series with the relay switch between the relay switch and the brake component. A driver selectively controls the solid state switch to selectively allow power to be supplied to the brake component only if the relay switch is closed and the monitored condition has the first status.

An exemplary method of controlling an elevator brake includes selectively closing a relay switch to allow power supply to an electrically activated elevator brake component responsive to a safety chain indicating that a monitored condition of a selected elevator system component has a first status. The relay switch is opened to prevent power supply to the brake component responsive to the monitored condition having a second, different status. Selective control of a solid state switch in series with the relay switch between the relay switch and the brake component selectively allows power to be supplied to the brake component only if the relay switch is closed and the monitored condition has the first status.

The various features and advantages of a disclosed example will become apparent to those skilled in the art from the following detailed description. The drawings that accompany the detailed description can be briefly described as follows.

BRIEF DESCRIPTION OF THE DRAWING

FIG. 1 schematically illustrates an example elevator brake control device designed according to an embodiment of this invention.

DETAILED DESCRIPTION

FIG. 1 schematically shows a device 20 for controlling an elevator brake 22. An electrically activated brake component 24, which comprises a brake coil in this illustrated example, is powered by a power source 26 for lifting the brake so that an associated elevator car (not illustrated) can move. The brake 22 comprises known components and operates in a known manner such that whenever no power is supplied to the brake component 24, a spring force (for example) applies the brake to prevent movement of the associated elevator car.

The illustrated device 20 provides control over when the brake 22 is applied or lifted. A relay switch 30 is associated with a safety chain 32 such that a coil 34 of the relay switch 30 is selectively energized depending on a condition monitored by the safety chain 32. The example safety chain 32 is configured to monitor the condition of any elevator door 36 (e.g., car door or hoistway door) of an associated elevator system 38. The safety chain 32 controls whether the coil 34 is energized to close the relay switch 30 depending on whether any of the doors is open. In this example, when all of the elevator doors are closed, that is considered a first status of the monitored condition. When at least one of the elevator doors is open, that is considered a second, different status of the monitored condition.

In this example, the relay coil 34 can only be energized when the first status exists (i.e., all of the elevator doors are closed) because it would not be desirable to move the elevator car when a door is open. If the second status exists (i.e., any of the doors is open), the safety chain 32 prevents the relay coil 34 from being energized and the relay switch 30 is open.

A solid state switch 40 is placed in series with the relay switch 30 between the relay switch 30 and the brake component 24. A driver 42 controls the solid state switch 40 to selectively control whether it is conducting and allowing power to be provided to the brake component 24 from the power source 26. In this example, the driver 42 is configured to control the switch 40 depending on the status of the relay switch 30 and the status of the monitored condition.

The example driver 42 receives an indication from the safety chain 32 regarding the status of the monitored condition. Whenever the monitored condition has the first status, the driver 42 receives an indication from the safety chain 32 that indicates that it is acceptable to activate the switch 40 for providing power to the brake component 24.

The driver 42 activates the switch 40 to provide power to the brake component 24 responsive to receiving an indication from the safety chain 32 that the status of the monitored condition corresponds to a situation in which the brake 22 should be lifted and an indication from the controller 44 to activate the switch 40 to allow power to be provided from the power source 26 to the brake component 24. Whenever the relay switch 30 is closed and the switch 40 is conducting, the brake component 24 receives power and releases or lifts the brake 22.

The indication that the controller 44 provides to the driver 42 is dependent on the operational status of the switches 30 and 40. The controller 44 has a monitoring portion 46 that determines whether the relay switch 30 is closed. In one example, the monitoring portion 46 is configured to detect a voltage on the coupling between the relay switch 30 and the switch 40. If the relay switch 30 should be closed because the monitored condition has the first status (e.g., all elevator doors are closed), there should be a voltage present on the coupling. The monitoring portion 46 detects whether there is an appropriate voltage. The monitoring portion 46 is useful for determining whether the relay switch 30 is closed when it should be and open when it should be.

The example controller 44 also has a monitoring portion 48 that is configured to confirm the operation of the switch 40. In this example, the monitoring portion 48 detects whether there is a voltage on the coupling between the switch 40 and the brake component 24. Whenever the switch 40 should be off or open, the monitoring portion 48 should indicate that there is no voltage present between the switch 40 and the brake component 24. The monitoring portion 48 also provides an indication whether the switch 40 is conducting when it should be. The monitoring portion 48 provides confirmation that the switch 40 is operating properly for only conducting power to the brake component under desired circumstances. In this example, the monitoring portion 48 provides an indication of any detected voltage to the controller 44 (e.g., whether there is any voltage and a magnitude of such a voltage).

In one example, the controller 44 provides an indication to another device (not illustrated) that reports whether either of the switches 30 or 40 is operating properly.

The controller 44 will only provide an indication to the driver 42 to activate (e.g., turn on or close) the switch 40 if the relay switch 30 and the switch 40 are operating as desired. Expected operation prior to activating the switch 40 for providing power to the brake component 24 in this example includes the monitoring portion 46 detecting a voltage on an "input" side of the switch 40 and the monitoring portion 48 not detecting any voltage on an "output" side of the switch 40. This confirms that the relay switch 30 is closed as desired and the switch 40 is off as desired. Once the switch 40 should have been activated by the driver 42, the controller 44 confirms proper operation of the switch 40 based on whether a voltage is detected by the monitoring portion 48.

The controller 44 has the ability to confirm the operation of each of the switches 30 and 40 in a manner that satisfies industry standards without requiring force guided relays, for example. The illustrated device provides cost and space savings compared to previous brake control arrangements that relied upon force guided relays. The relay switch 30 and the switch 40 can be smaller and much less expensive devices compared to force guided relays. In one example, the relay switch 30 comprises a single pole double throw relay. In one example, the switch 40 comprises a semiconductor switch such as a MOSFET or a TRIAC.

The combination of inputs to the driver 42 from each of the safety chain 32 and the controller 44 regarding the monitored condition and the proper operation of switches, respectively, provides control over providing power to the brake component 24 in a manner that satisfies industry standards for monitoring and controlling power supply to an elevator brake.

The illustrated example provides control over power supply to an elevator brake in a manner that provides indications to ensure that the switching components are operating properly without the drawbacks associated with previous arrangements that required larger and more expensive components. The illustrated example provides cost and space savings without sacrificing performance or monitoring capability.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. An elevator brake control device, comprising:

a relay switch that is associated with a safety chain configured to monitor at least one condition of a selected elevator system component, the relay switch selectively being closed to allow power supply to an electrically activated elevator brake component responsive to the monitored condition having a first status, the relay switch being selectively opened to prevent power supply to the brake component responsive to the monitored condition having a second, different status;

a solid state switch in series with the relay switch between the relay switch and the brake component;

a driver that selectively controls the solid state switch to selectively allow power to be supplied to the brake component through the relay switch, the driver operating the solid state switch to conduct power depending on a status of the relay switch and only if the relay switch is closed and the monitored condition has the first status.

2. The device of claim 1, wherein the driver otherwise prevents the solid state switch from allowing power to be supplied to the brake component.

3. The device of claim 1, comprising a monitor that determines the status of the relay switch and provides an indication of the status of the relay switch to the driver.

4. The device of claim 3, wherein the monitor determines whether there is a voltage on a coupling between the relay switch and the solid state switch.

5. The device of claim 3, wherein the driver is associated with the safety chain to receive an indication of the status of the monitored condition.

6. The device of claim 3, wherein the monitor determines whether the solid state switch is activated to allow power to be provided to the brake component.

7. The device of claim 6, wherein the driver activates the solid state switch to allow power to be supplied to the brake component only if the solid state switch is off when the relay switch is closed and the monitored condition has the first status.

8. The device of claim 1, wherein the solid state switch comprises a semiconductor switch.

9. The device of claim 8, wherein the solid state switch comprises a MOSFET.

10. The device of claim 8, wherein the solid state switch comprises a TRIAC.

11. The device of claim 1, wherein the monitored condition comprises a condition of at least one elevator door;

the first status comprises the at least one elevator door being closed; and the second status comprises the at least one elevator door being open.

12. A method of controlling an elevator brake, comprising the steps of:

selectively closing a relay switch to allow power supply to an electrically activated elevator brake component responsive to a safety chain indicating that a monitored condition of a selected elevator system component has a first status;

selectively opening the relay switch to prevent power supply to the brake component responsive to the monitored condition having a second, different status;

selectively controlling a solid state switch in series with the relay switch between the relay switch and the brake component to selectively allow power to be supplied to the brake component through the relay switch by controlling the solid state switch to conduct power depending on a status of the relay switch and only if the relay switch is closed and the monitored condition has the first status.

13. The method of claim 12, comprising otherwise preventing the solid state switch from allowing power to be supplied to the brake component.

14. The method of claim 12, comprising monitoring the status of the relay switch and providing an indication of the status of the relay switch to a driver that controls the solid state switch.

15. The method of claim 14, comprising monitoring the status of the relay switch by determining whether there is a voltage between the relay switch and the solid state switch.

16. The method of claim 14, comprising determining whether the solid state switch is activated to allow power to be provided to the brake component.

17. The method of claim 16, comprising activating the solid state switch to allow power to be supplied to the brake component only if the solid state switch is off when the relay switch is closed and the monitored condition has the first status.

18. The method of claim 14, wherein the driver is associated with the safety chain to receive an indication of the status of the monitored condition.

19. The method of claim 12, comprising determining whether the solid state switch is activated to allow power to be provided to the brake component when the relay switch is closed and the monitored condition has the first status.

20. The method of claim 12, wherein the monitored condition comprises a condition of at least one elevator door;

the first status comprises the at least one elevator door being closed; and the second status comprises the at least one elevator door being open.

* * * * *